US009506192B2

(12) United States Patent
Johnson et al.

(10) Patent No.: US 9,506,192 B2
(45) Date of Patent: Nov. 29, 2016

(54) SYSTEMS AND METHODS FOR DOCTOR BLADE LOAD AND VIBRATION MEASUREMENT AS WELL AS BLADE VIBRATION MITIGATION

(71) Applicant: Kadant Inc., Westford, MA (US)

(72) Inventors: Robert P. Johnson, Sutton, MA (US); Allen Brauns, Sturbridge, MA (US)

(73) Assignee: Kadant, Inc., Westford, MA (US)

( * ) Notice: Subject to any disclaimer, the term of this patent is extended or adjusted under 35 U.S.C. 154(b) by 0 days.

(21) Appl. No.: 14/263,335

(22) Filed: Apr. 28, 2014

(65) Prior Publication Data

US 2015/0075742 A1 Mar. 19, 2015

Related U.S. Application Data

(60) Provisional application No. 61/816,318, filed on Apr. 26, 2013.

(51) Int. Cl.

| | |
|---|---|
| ***D21G 7/00*** | (2006.01) |
| ***D21G 3/00*** | (2006.01) |
| ***D21G 3/04*** | (2006.01) |

(52) U.S. Cl.

CPC ..... *D21G 3/005* (2013.01); *D21G 3/00* (2013.01); *D21G 3/04* (2013.01)

(58) Field of Classification Search

CPC ..... D21G 7/00
USPC ..... 162/252, 263, 198, 281, 111
See application file for complete search history.

(56) References Cited

U.S. PATENT DOCUMENTS

| | | | | |
|---|---|---|---|---|
| 5,066,364 | A | 11/1991 | Goodnow et al. | |
| 5,783,042 | A | 7/1998 | Leeman et al. | |
| 7,108,766 | B1 | 9/2006 | Eskelinen et al. | |
| 7,309,402 | B2 * | 12/2007 | Reid et al. | 162/281 |
| 2010/0186770 | A1 | 7/2010 | Johnson et al. | |

FOREIGN PATENT DOCUMENTS

| | | | |
|---|---|---|---|
| EP | 2355224 | A1 | 8/2011 |
| WO | 2008140339 | A1 | 12/2008 |
| WO | 2014176590 | A1 | 10/2014 |

OTHER PUBLICATIONS

International Search Report and Written Opinion mailed on Sep. 1, 2014 in connection with International Application PCT/US14/035668, 13 pages.

International Preliminary Report on Patentability mailed on Nov. 5, 2015 in connection with related International application No. PCT/US2014/035668, 10 pages.

* cited by examiner

*Primary Examiner* — Mark Halpern
(74) *Attorney, Agent, or Firm* — Gesmer Updegrove LLP

(57) ABSTRACT

A doctor blade cartridge for use in a doctor blade holder is disclosed. The doctor blade cartridge is for receiving a doctor blade, and includes at least one blade supporting member, wherein the blade supporting member is sufficiently stiff to support the doctor blade and includes load indication means for providing a signal indicative of at least one of blade supporting member strain and blade supporting member deflection.

33 Claims, 19 Drawing Sheets

SYSTEMS AND METHODS FOR DOCTOR BLADE LOAD AND VIBRATION MEASUREMENT AS WELL AS BLADE VIBRATION MITIGATION

PRIORITY

The present application claims priority to U.S. Patent Application Ser. No. 61/816,318 filed Apr. 26, 2013, the disclosure of which is hereby incorporated by reference in its entirety.

BACKGROUND

This invention generally relates to doctoring systems, and relates in particular to doctor blade holders that provide improved performance of doctoring systems during the production of tissue and paper.

While efforts have been made to measure doctor blade loads in order to provide improved performance of doctoring systems, such measurements of doctor blade loads have conventionally been limited to measuring applied cylinder load, such as disclosed in U.S. Pat. No. 5,783,042. These measurements represent the total applied load to the doctor, and therefore the average reaction load at the blade tip. This measurement however, has several shortcomings. First, the measurement is representative of the blade load component considered normal to the dryer (Yankee) surface, and thus does not accurately represent the load that is tangential to the dryer surface, that load being more representative of friction and other blade-surface interface behavior. Second, the measurement does not represent the variation in the blade load that exists lengthwise along the dryer face width. Third, the total applied cylinder load also includes contributions from various other factors such as weight unbalance moment and bearing friction, and therefore a fraction of the measured cylinder load represents the blade load.

In certain applications, it is desired to provide improved reliability in Yankee coating and creping systems within the tissue industry. In such applications, it is sometimes desired to monitor numerous coating and creping parameters. In tissue production for example, the conventional Yankee doctor blade carrier includes a cartridge, as disclosed in U.S. Pat. No. 5,066,364. Conventional techniques for providing vibration measurements in such systems have typically involved mounting sensors on the doctor beam. These locations however, are removed from the blade tip, and thus unique vibration signatures that may be present in the blade tip that may go undetected.

There remains a need therefore, for doctor blade holders that provide improved performance, particularly for the production of tissue and paper.

SUMMARY

In accordance with certain embodiments, the invention provides a doctor blade cartridge for use in a doctor blade holder. The doctor blade cartridge is for receiving a doctor blade and includes at least one blade supporting member. The blade supporting member is sufficiently stiff to support the doctor blade and includes load indication means for providing a signal indicative of at least one of blade supporting member strain and blade supporting member deflection.

In accordance with another embodiment, the invention provides a doctor blade cartridge for use in a doctor blade holder, and the doctor blade cartridge is for receiving a doctor blade and includes at least one blade supporting member. The at least one blade supporting member is sufficiently stiff to support the doctor blade and includes vibration measurement means for providing a vibration signal indicative of vibration of the at least one blade supporting member.

In accordance with a further embodiment, the invention provides a doctor blade cartridge for use in a doctor blade holder, wherein the doctor blade cartridge is for receiving a doctor blade and includes at least one blade support member that is sufficiently stiff to support the doctor blade and includes damping means for reducing blade vibration.

BRIEF DESCRIPTION OF THE DRAWINGS

The following description may be further understood with reference to the accompanying drawings in which.

The drawings are shown for illustrative purposes only and are not necessarily to scale.

DETAILED DESCRIPTION

In accordance with certain embodiments, the present invention facilitates the measurement of blade load and blade vibration during the production of tissue and paper, as well as the reduction of blade vibration during the production of tissue and paper. As mentioned above, the conventional Yankee doctor blade carrier includes a cartridge for receiving and supporting the doctor blade as disclosed for example, in U.S. Pat. No. 5,066,364, the disclosure of which is hereby incorporated by reference in its entirety. Such a cartridge is generally comprised of two side walls that sandwich a row of spacers, and the spacers provide the load support points for the blade. A doctor blade is received within the cartridge of the doctor blade holder.

In accordance with certain embodiments, a sensor measurement point is located directly at the blade support, affording very accurate load and vibration measurements associated with blade behavior. In particular, in certain embodiments the conventional spacer component is replaced with a blade supporting member (e.g., a beam component), uniquely designed to simultaneously achieve the necessary stiffness for proper dynamic performance of the doctor blade (e.g., creping blade or cleaning blade), and adequate deflection such that a structural parameter such as strain or deflection or vibration may be measured.

Figure 1A:
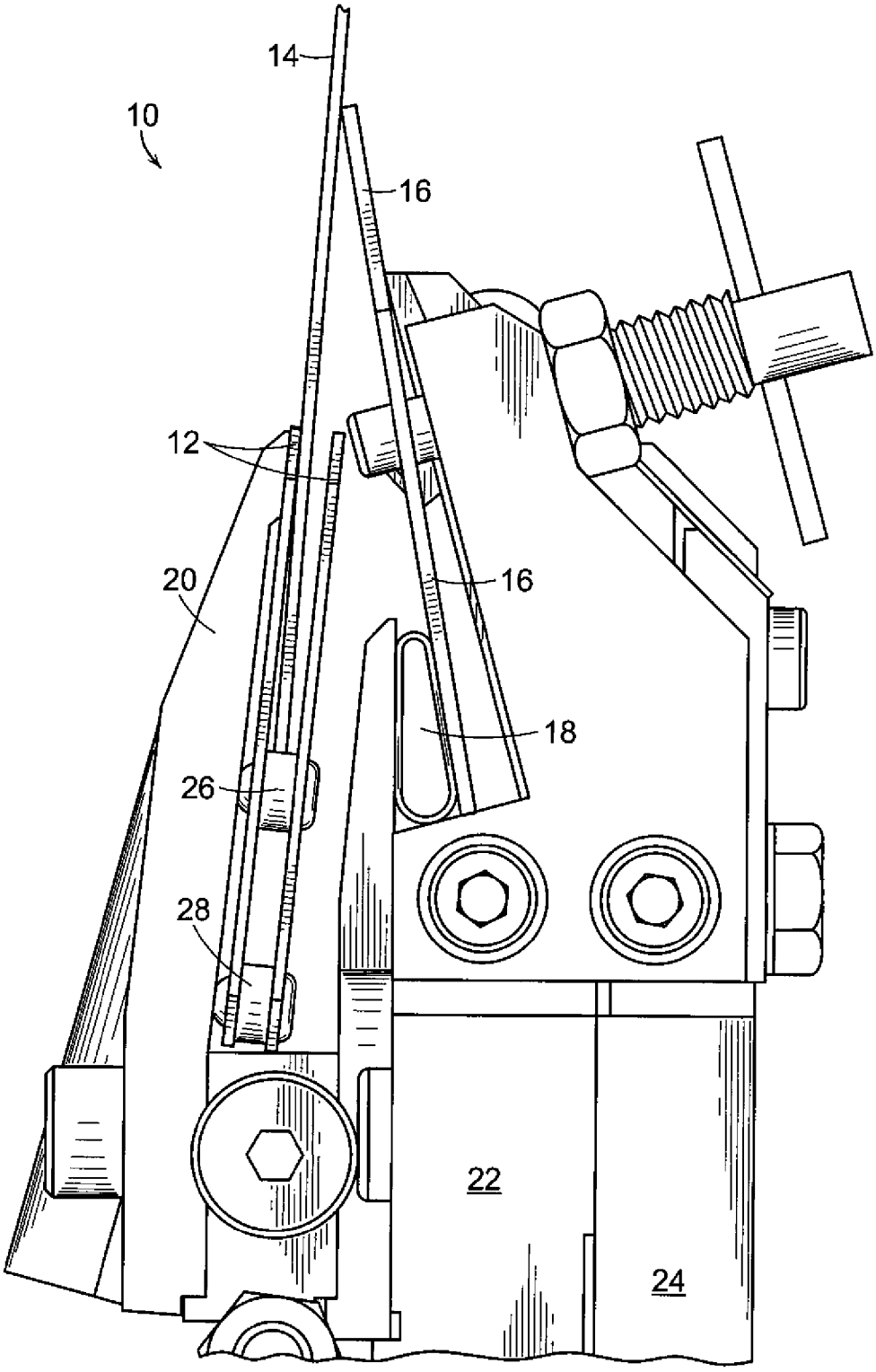
FIGS. 1A-1C show an illustrative diagrammatic view of a doctor blade holder system including a doctor blade cartridge in accordance with an embodiment of the invention (FIG. 1A), an illustrative diagrammatic side view of the doctor blade cartridge (FIG. 1B), and an illustrative partial front view of the doctor blade cartridge and the doctor blade (FIG. 1C)

FIG. 1A shows a doctor blade holder 10 that includes a doctor blade cartridge 12 for receiving a doctor blade 14 in accordance with an embodiment of the invention. The doctor blade holder also includes a back-up blade 16 that may be urged against the doctor blade 14 by actuation of a set screw 18, as well as a top plate 20 and a bottom plate 22. The bottom plate 22 is mounted to a doctor back 24. The doctor blade holder may also include a self-compensating load tube 18 as disclosed, for example, in U.S. patent application Ser. No. 14/263,700 filed Apr. 28, 2014, the disclosure of which is hereby incorporated by reference in its entirety. The self-compensating load tube 17 assists the working blade to conform to a roll crown.

Figure 1C:
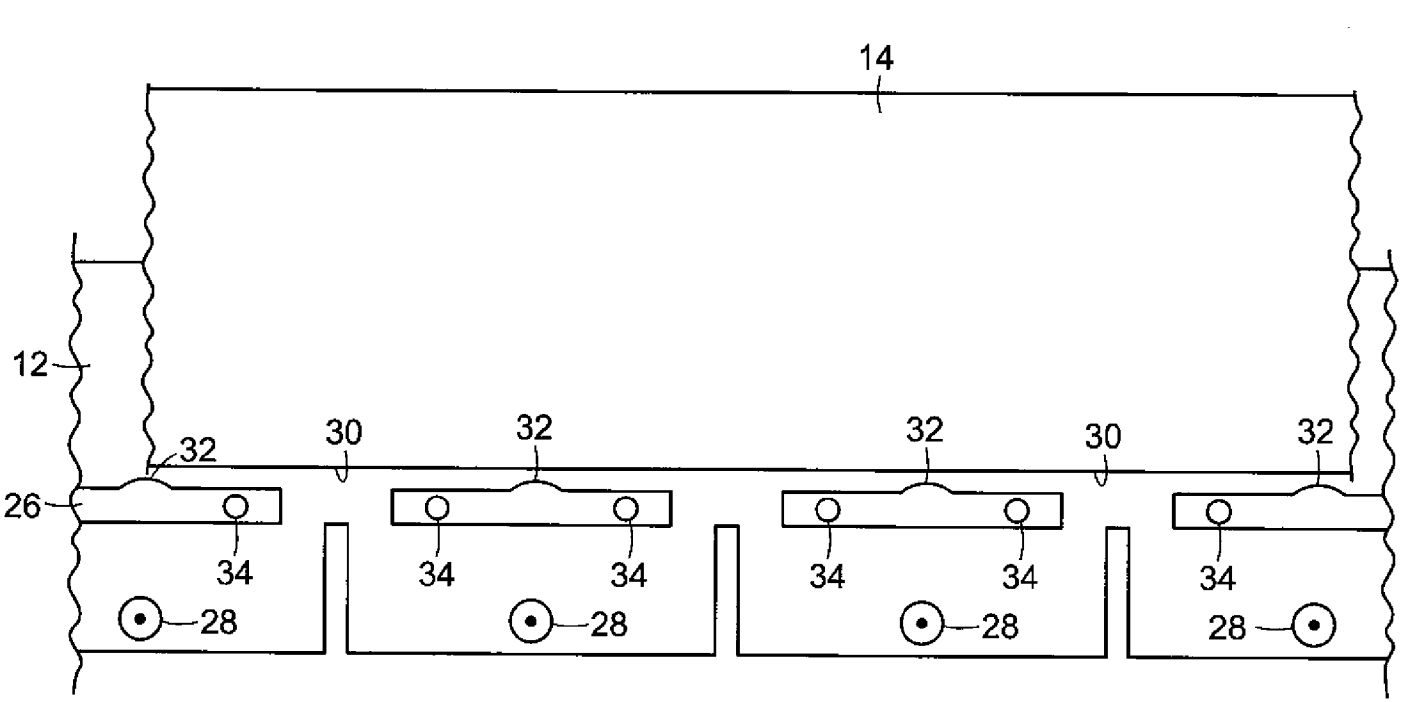
Figure 1B:
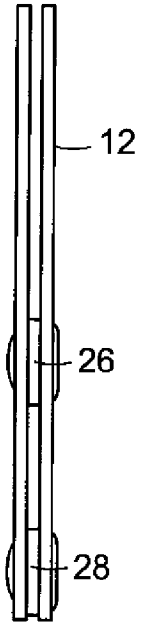

As further shown in FIG. 1B (in which one side of the doctor blade cartridge is not shown for clarity), the doctor blade cartridge 12 includes a top row of spacers that function as blade supporting members 26 as well as a bottom row of spacers 28. The doctor blade 14 includes a bottom edge 30, portions of which contact support surfaces 32 of the blade support members 26. In accordance with various embodiments of the invention, the blade support members 26 may be mounted to the doctor blade cartridge by mounts 34 such that each blade support member functions as a beam. The spacers are connected to the cartridge sidewalls via a rivet, or other suitable means. In accordance with various embodiments, only a portion of the top row of spacers may include blade support members, with the remaining spacers in the top row being the same as those used in the bottom row of spacers.

Figure 2:
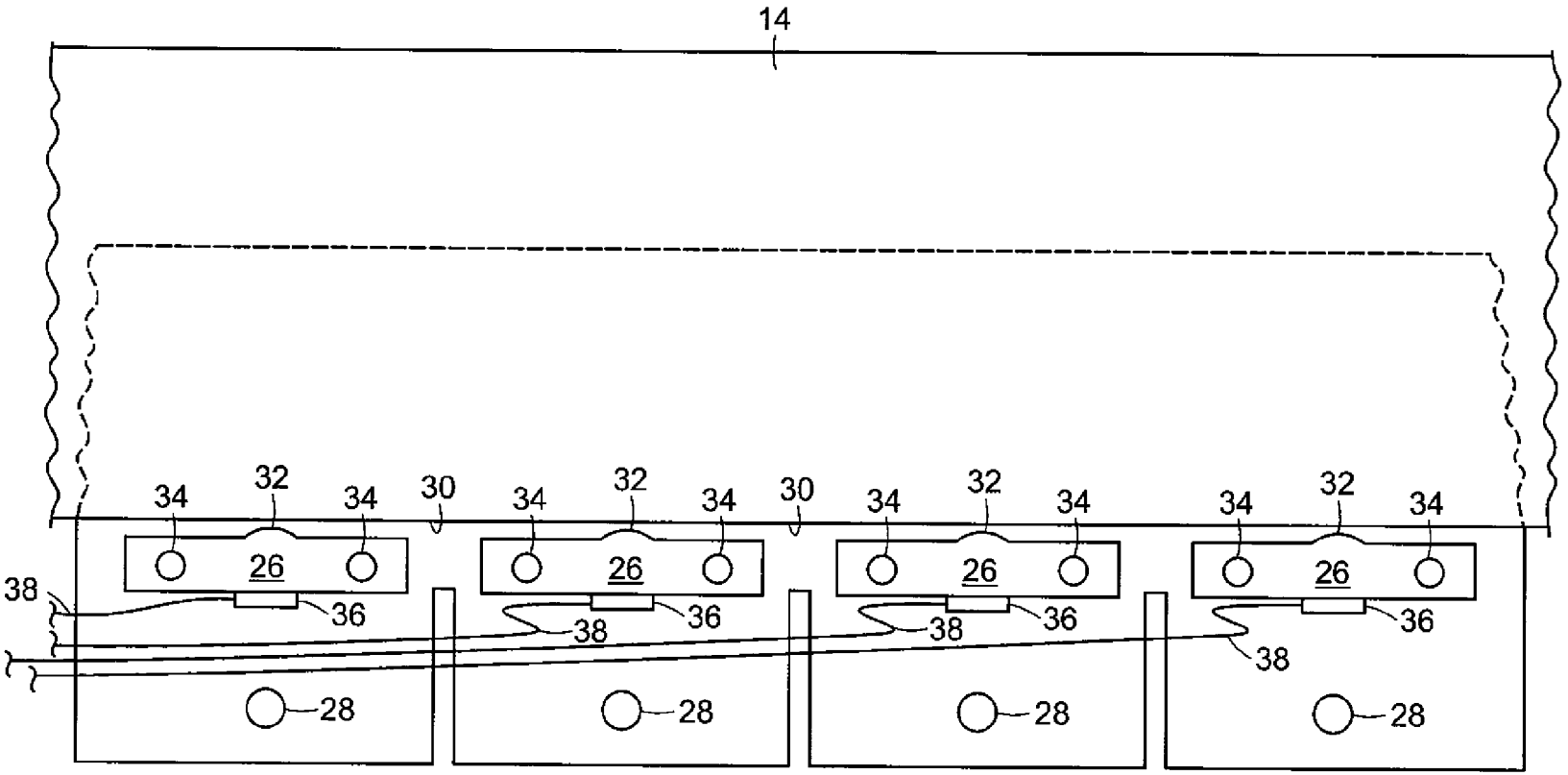
FIG. 2 shows an illustrative diagrammatic partial front view of a doctor blade cartridge and doctor blade in accordance with another embodiment of the invention.

FIG. 2 shows the doctor blade cartridge of FIGS. 1A-1C further including load indication units 36 that provide output signals (via connections 38) that are indicative of at least one of blade support member strain or blade support member deflection.

Figure 3A:
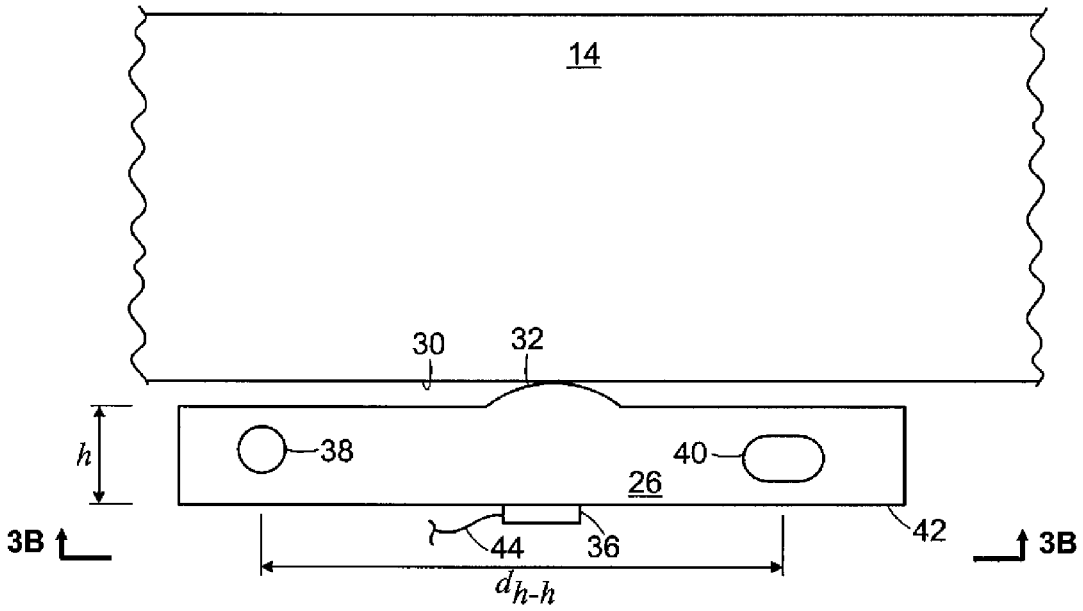
FIGS. 3A-3E show an illustrative diagrammatic front view of a blade supporting member and doctor blade in accordance with a further embodiment of the invention (FIG. 3A), an illustrative diagrammatic bottom view of the blade supporting member of FIG. 3A taken along line 3B-3B thereof (FIG. 3B), an illustrative diagrammatic bottom view similar to that of FIG. 3B of a blade supporting member in accordance with another embodiment (FIG. 3C), an illustrative diagrammatic front view of the blade supporting member of FIG. 3A (FIG. 3D), and an illustrative diagrammatic sectional view of the blade supporting member of FIG. 3D taken along line 3E-3E thereof (FIG. 3E)
Figure 3B:
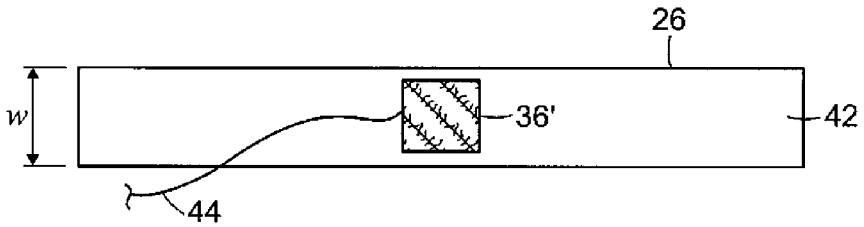
Figure 3C:
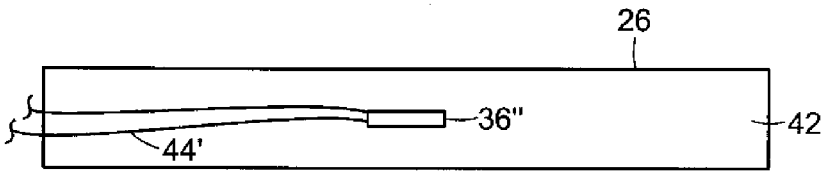

In particular, FIG. 3A shows a detailed look at a blade support beam 26. The beam 26 is produced typically of standard hardenable stainless steel, although other choices of material could be used. Given a material selection, the stiffness and deflection structural parameters are then dictated by the beam geometry; beam length, width and height, and the beam support boundary conditions, typically simply supported or clamped (fixed) supports. A sensor 36 such as a strain gage (36' shown in FIG. 3B), or a fiber optic strain sensor (36" shown in FIG. 3C), or other suitable sensor is attached to the underside of the beam 26. In various embodiments, the strain gage 36' may be oriented in a position ninety degrees rotated with respect to that shown in FIG. 3B.

The beam 26 of FIG. 3A is simply supported at hole 38 for receiving a mount 34, and at slot 40 also for receiving a mount 34. The slot 40 is used to ensure that the beam is not otherwise constrained lengthwise. The hole to hole distance $d_{h\text{-}h}$ dictates the active length of the beam. In the practical case the width w would be matched to the conventional spacer width, e.g., about 0.155 inches. The width however, may be chosen for other practical reasons such as sensor cable runs, attachments of accelerometers, strain gage geometry, etc., provided that the sensor output levels are sufficient. The height h is chosen in conjunction with the active length to maximize both stiffness and strain. High stiffness is required to avoid initiating blade chatter, while high strain is required to achieve robust sensor measurements.

The doctor blade 14 rests on the support surfaces 32, which would be narrow in length such that as wear took place, the load would still be primarily applied to the beam midspan. The surfaces 32 could be hardened via heat treatment, or a hard coat such as Electroless Nickel coating could be applied. This would promote life of the support surface and thus beam life. The underside 42 is straight, which may be a requirement for certain fiber optic cables 44, but is also suitable for strain gage applications as well.

Figure 3D:
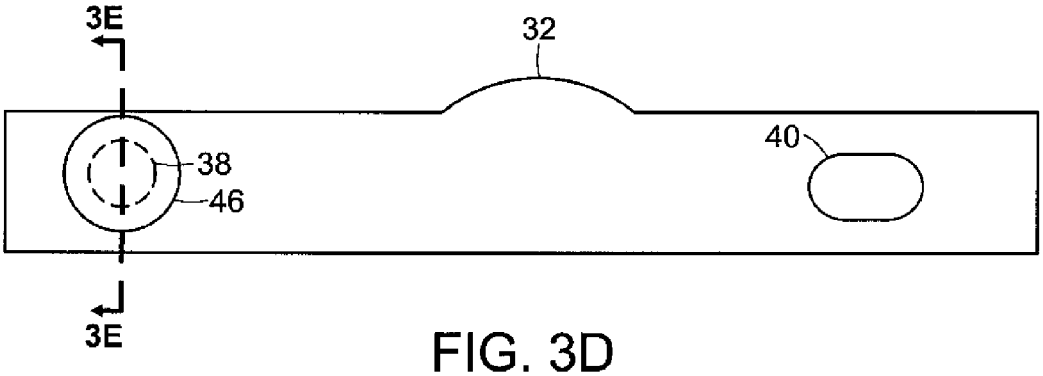
Figure 3E:
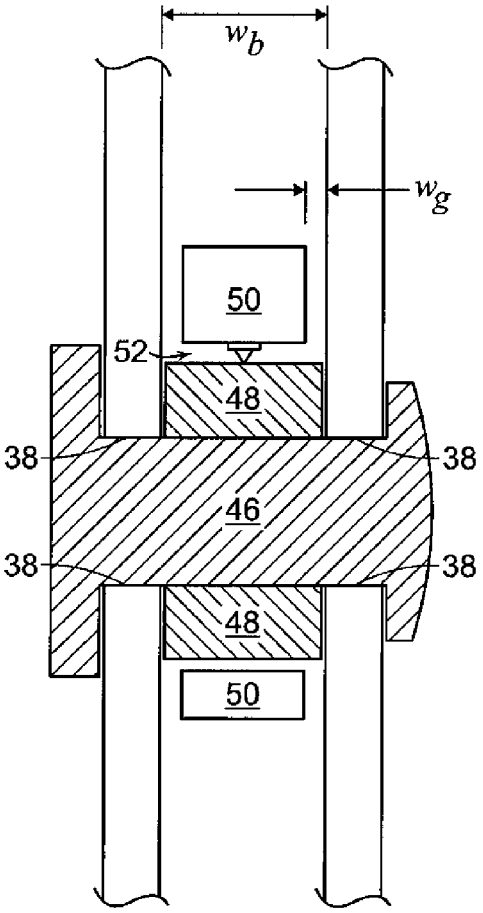
Figure 4A:
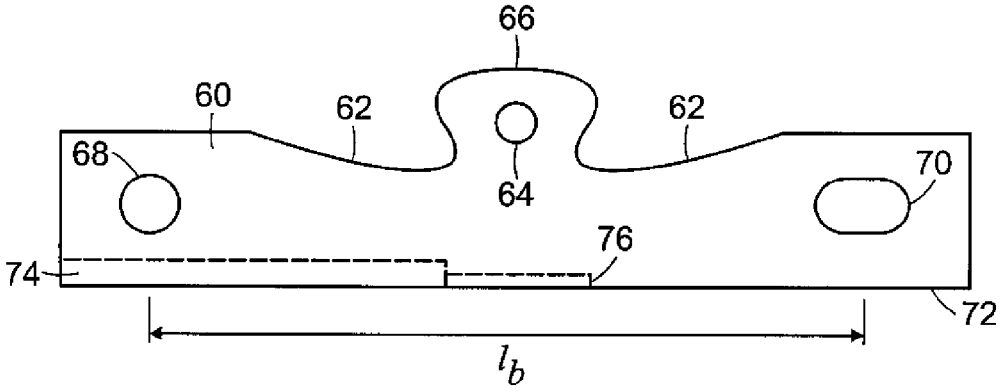
FIGS. 4A and 4B show an illustrative diagrammatic front view of a blade supporting member in accordance with a further embodiment of the invention (FIG. 4A), and a bottom view of the blade supporting member of FIG. 4A taken along line 4B-4B thereof (FIG. 4B)
Figure 4B:
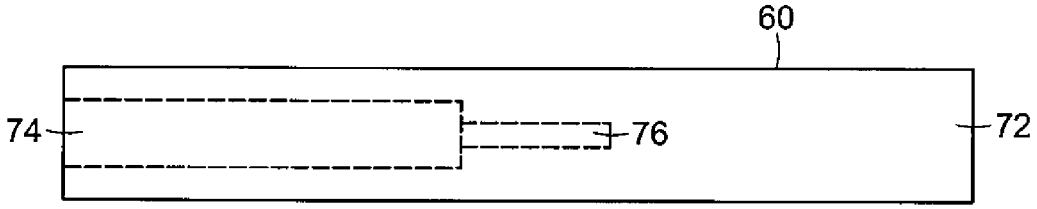

In the embodiment shown in FIG. 3A, the blade supporting beam 26 is connected to the doctor blade cartridge sidewalls via a rivet and bushing assembly. In particular, and as shown in FIGS. 3D and 3E, a rivet 46 expands into a bushing 48, and there is a slight radial clearance (as shown at 52) between the bushing 48 and beam portion 50. This ensures free rotation at the supports. The width $w_b$ of bushing 48 is slightly larger than the beam width, resulting in a slight gap (as shown at $w_g$). This avoids friction or constraint caused by the rivet clamping influence. In this embodiment, the rivet clamping force passes through the bushing, not through the beam. There are a number of other ways to achieve this simply support arrangement, such as through the use of other fasteners. All other simply supported arrangements, as well as those arrangements achieving a clamped end condition are all considered to be within the spirit of the present invention.

In accordance with another embodiment, a blade supporting beam 60 may include midspan depression surfaces 62, as well as an opening 64 in the portion that provides the support surface 66 for supporting the doctor blade. Since the target location for maximum strain measurement is at the midspan, this beam profile may allow higher strain to be achieved at the midspan, without detrimental compromise in stiffness. Support hole 68 and slot 70 dictate the active beam length $L_b$. On the underside of the beam as shown at 72, a groove 74 may be machined in the beam for application and anchoring of the fiber optic cable, and fiber optic strain sensor 76. The bottom surface is otherwise flat, so as to avoid bend radii in the fiber optic sensor and cable.

Figure 5:
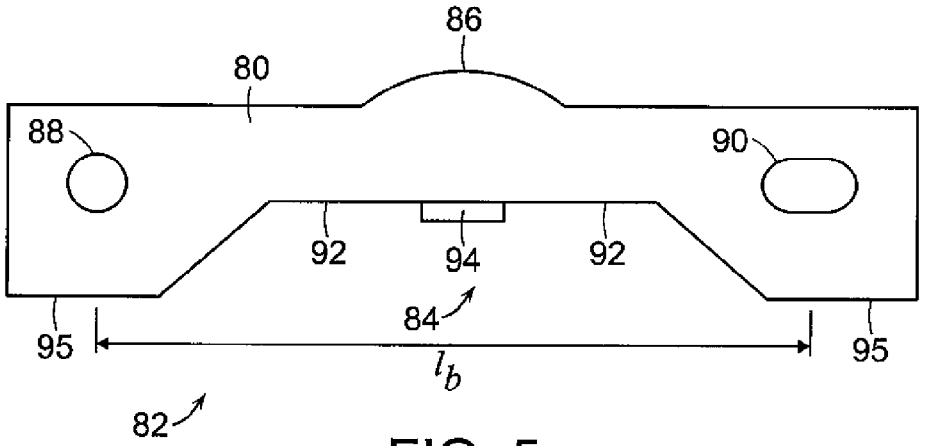
FIG. 5 shows an illustrative diagrammatic front view of a blade supporting member in accordance with a further embodiment of the invention that includes a non-flat bottom surface for higher strain gage applications.

Another beam variation is shown in FIG. 5, which may be well suited for certain strain gage applications. In this case the underside 82 of the blade supporting beam 80 is not continuously flat, and instead includes a recessed portion 84. This enables higher strain levels to be achieved for the same stiffness as compared with the fiber optic beam. The blade is supported at surface 86. Support hole 88 and slot 90 dictate the active beam length $L_b$. The midspan portion 92 of the underside surface 82 is flat for mounting a strain gage 94 as discussed above. Such a gage is preferably an active half bridge or active full bridge for achieving temperature compensation. Temperature compensating gages can be placed on surface 92, or on the outboard surfaces 95.

In both the cases of the fiber optic sensor system, and strain gage sensor system, not only can the average value of load be measured, but data acquisition sampling rates can be high to allow dynamic measurements as well. In the case of the fiber optic sensor, the commercially available sampling rate is as high as 1000 samples per second, providing a frequency spectrum available of up to approaching 500 Hz. In the case of the strain gage, data acquisition is available for sample rates up to 100,000 samples per second, providing much that a broader frequency spectrum may be obtained with strain gages. The load frequency spectrum may offer great insight in establishing process load signatures.

Figure 6:
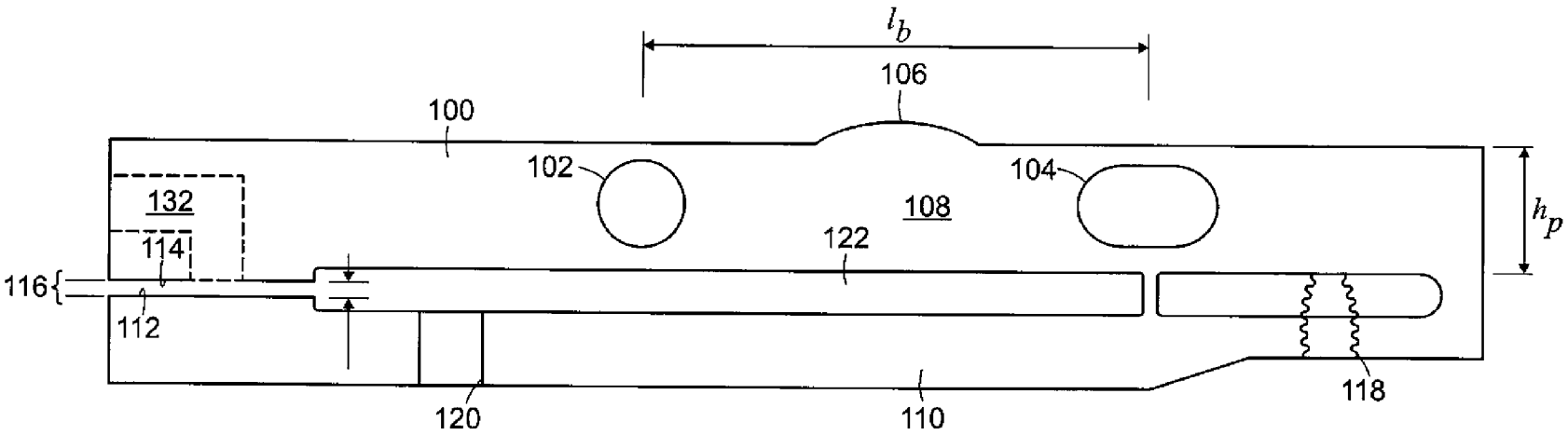
FIG. 6 shows an illustrative diagrammatic front view of a blade supporting member in accordance with a further embodiment of the invention including a variable air discharge gap.

Another beam variation that utilizes an alternative sensing means is shown in FIG. 6. In this embodiment support hole 102 and slot 104 of the beam 100 dictate the active beam length $L_b$, which is much shorter than the overall length of the beam 100. The blade is supported at surface 106. The height profile $h_p$ of the active beam portion 108 is chosen with the active length 44, such to achieve high stiffness, and high deflection of the underside portion 110, which acts as a lever 46 such that the surface 112 of the underside portion 110 may move relative to surface 114 of the active beam portion 108. At the surface 114, an air passage discharge exists, and the discharge has an effective area that is regulated by the discharge gap 116. As blade load increases, so does the gap 116. At typical loads, the discharge gap 116 may be typically 0.005-0.010 inches, in which inertial flow will dominate.

In the manufacturing process of pneumatic beam 100 of FIG. 6, there may be an initial gap 116 in the absence of pressure. A means of closing this gap is accomplished by turning adjustment screw 118 to preload the lever portion 110, in a manner such that gap 116 is closed initially under no load and room temperature conditions. In certain applications, it is important to preload lever portion 110 in a manner such that gap 116 is just closed, with minimal contact force between surfaces 112 and 114. An opening 120 in the internal cavity 122 defined between the active beam portion 108 and the underside portion 110 may also be used to regulate the operating size of the gap in various embodiments.

Figure 7:
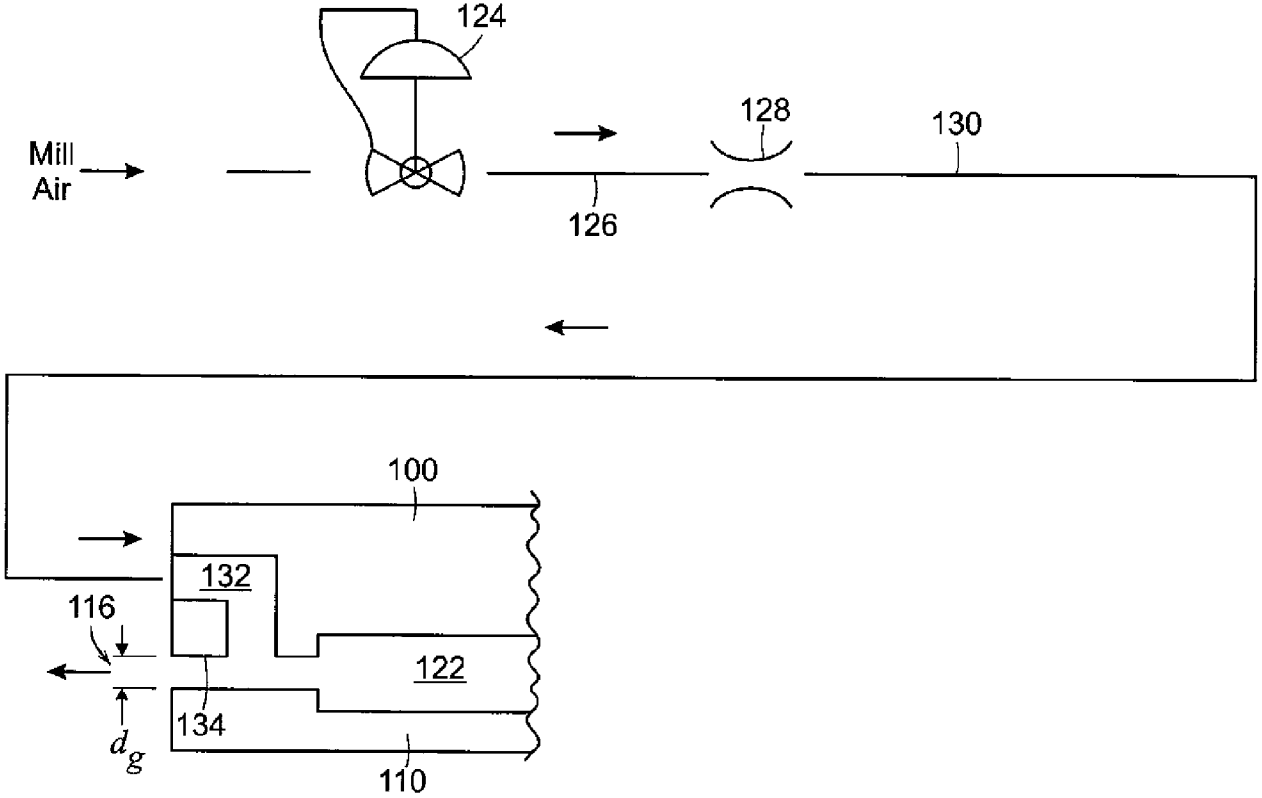
FIG. 7 shows an illustrative diagrammatic view of an air discharge measurement system using the blade support member of FIG. 6.

With reference to FIG. 7, air (e.g., instrument quality mill air) is provided to the beam 100 via an air regulation system. In particular, a pressure regulating valve 124 discharges air at a set pressure at 126. The air will flow through an upstream restrictor 128, reducing in pressure at the discharge side 130 of restrictor 128. Air then arrives at a beam inlet to a passage 132 that leads to the internal cavity 122 as well as the gap 116 having an opening distance $d_g$. Air will then flow to discharge at surface 134, and radially through discharge gap 116. In accordance with this embodiment, the blade load applied at surface 106, will deflect the beam lever 110 in such a way that gap 116 will be nearly linear with load.

Figure 8:
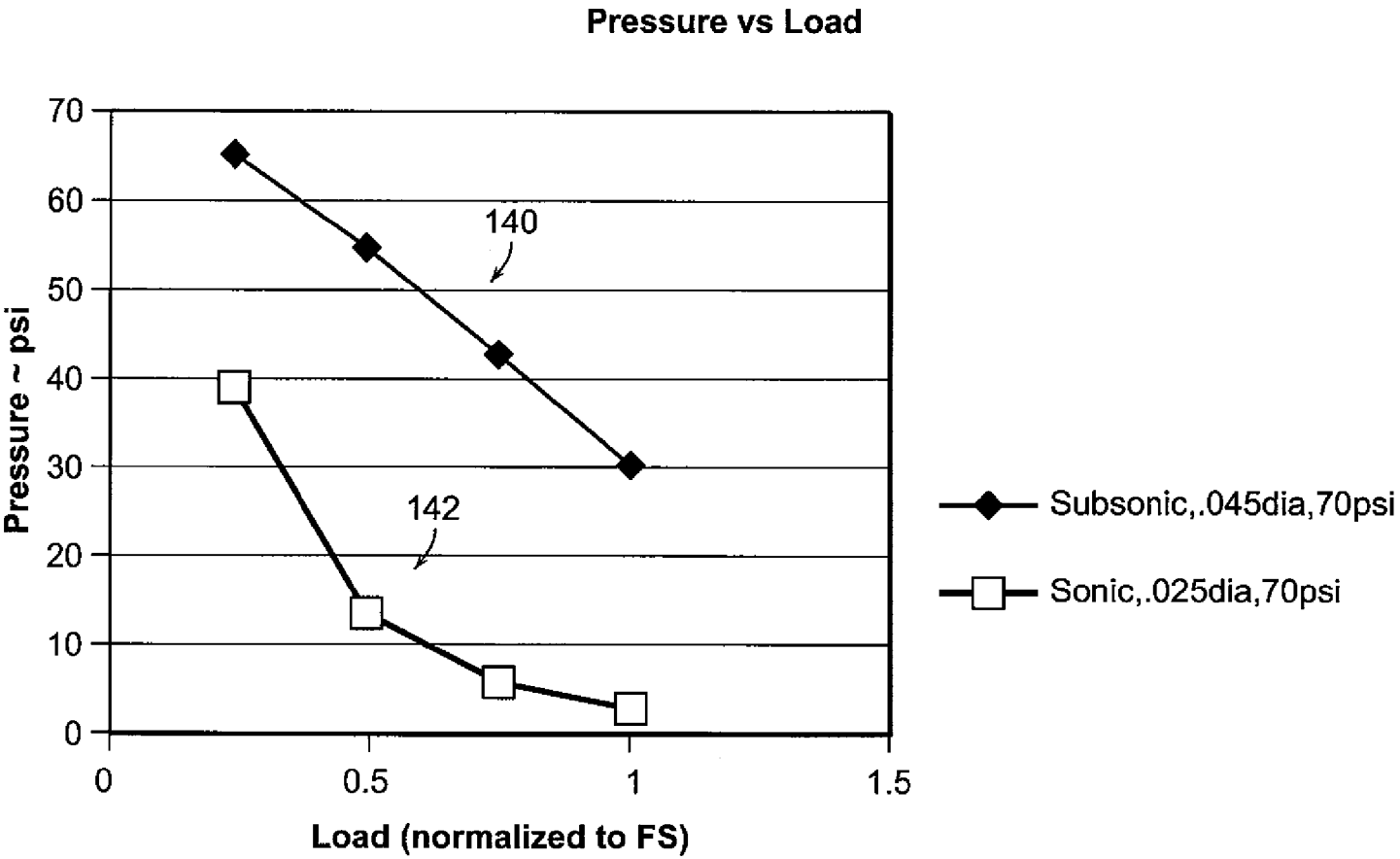
FIG. 8 shows an illustrative graphical representation of pressure vs. load for a blade support member in accordance with an embodiment of the invention.

It is also preferred that upstream valve 124 be large enough so that sonic conditions prevail at discharge gap 116, rather than at restrictor 128. The resulting relationship between pressure at 130 and blade load at surface 106 will approach linear over most of the load range. If sonic conditions were allowed to prevail at restrictor 128, then the relationship between pressure at 130 and blade load at surface 106 would be significantly nonlinear. A linear relationship is much preferred for sensing purposes. In various embodiments, the sensing may be achieved upstream of the beam (e.g., at valve 124 or restrictor 128) or downstream as air exits the gap 116. FIG. 8 compares a pressure-load relationship for the two flow conditions. In particular, the relationship for a subsonic pressure, with a 0.045 diameter opening and 70 psi is shown at 140, and the relationship for a subsonic pressure, with a 0.025 diameter opening and 70 psi is shown at 142.

The pneumatic beam load measurements will be limited to an average load value or dynamic measurements up to very low frequency at best. This is because of the slow response of the pneumatic system, as compared with the fast response of the fiber optic system and the strain gage system.

The ambient temperature is in the vicinity of 200° F.-250° F. typically, and the beam metal temperature will be that as well. The typical temperature of the air supply will be much less, more typically 80° F.-100° F. total temperature at the upstream source. At the discharge at gap 116, the static temperature will decrease further owing to the high velocity and adiabatic expansion.

Figure 9A:
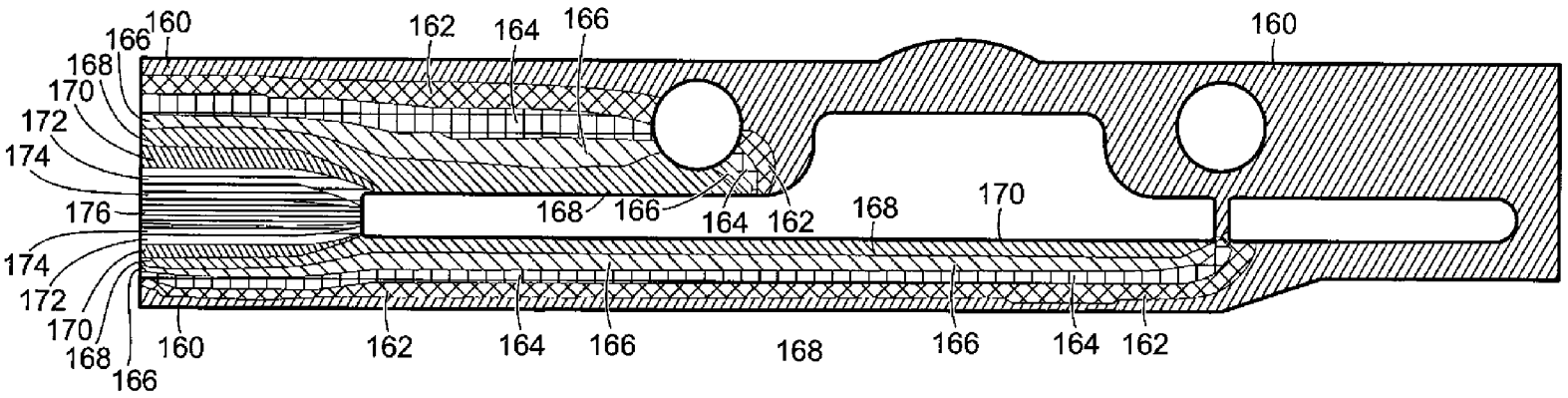
FIGS. 9A and 9B show an illustrative diagrammatic view of temperature gradient across a blade support member in accordance with a further embodiment of the invention (FIG. 9A), and an illustrative diagrammatic view of an associated temperature gradient scale (FIG. 9B)
Figure 9B:
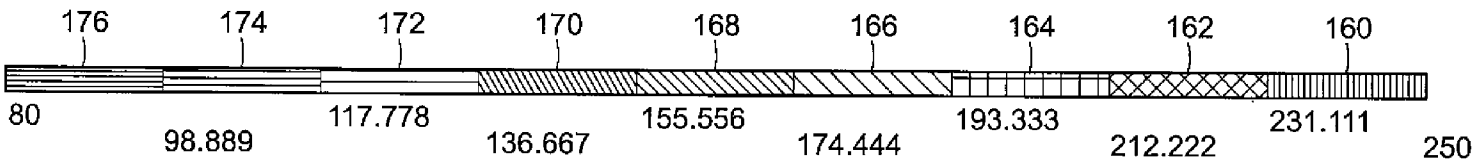
Figure 10A:
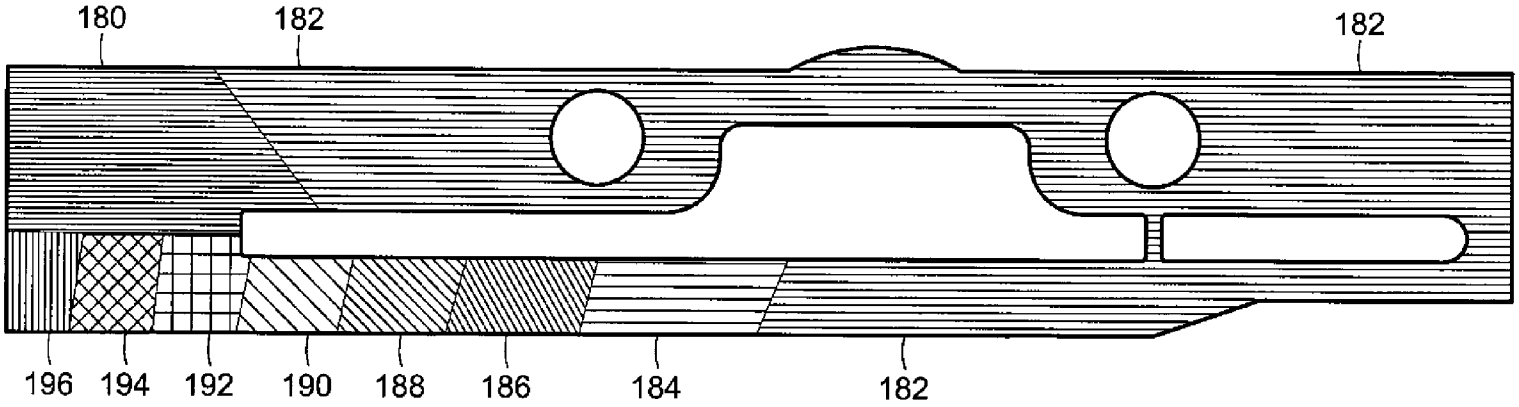
FIGS. 10A and 10B show an illustrative diagrammatic view of distortion resulting from the temperature gradient of FIG. 9 (FIG. 10A), and an illustrative diagrammatic view of an associated distortion scale (FIG. 10B)
Figure 10B:
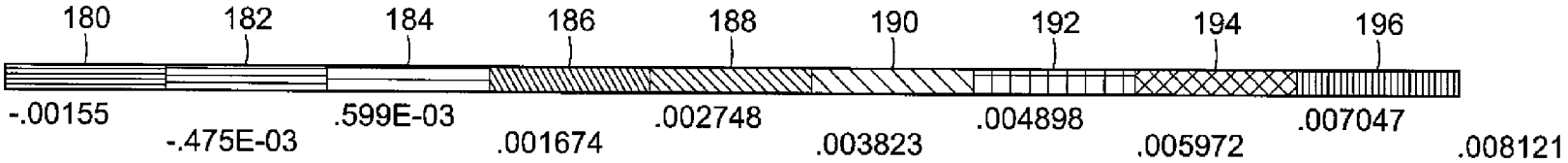

This could result in a significant temperature gradient across the lever thickness as suggested in FIGS. 9A and 9B, which show temperature gradients at 160, 162, 164, 166, 168, 170, 172, 174 and 176. FIGS. 10A and 10B show resulting distortion as shown at 180, 182, 184, 186, 188, 190, 192, 194 and 196.

Figure 11:
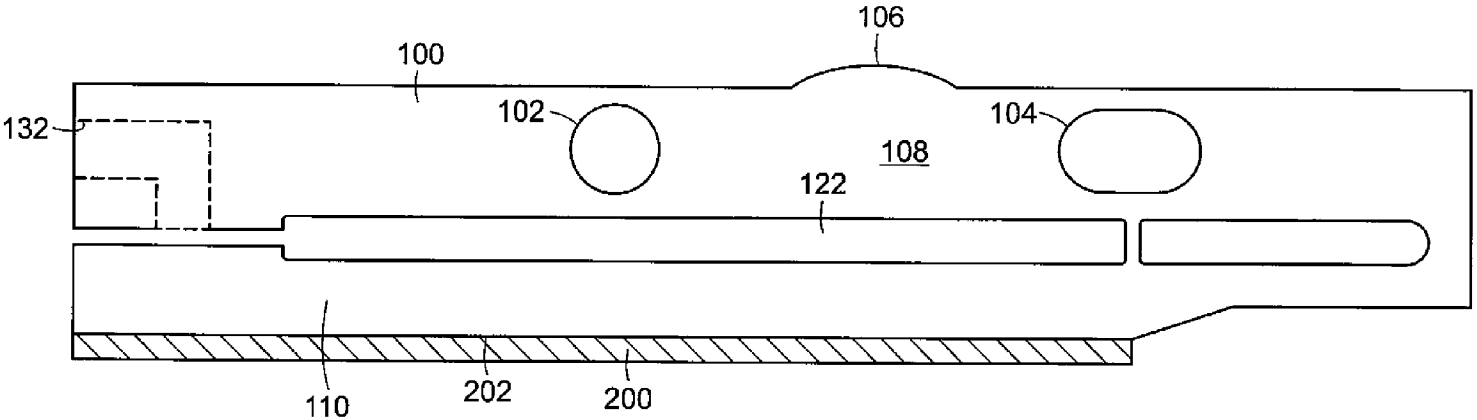
FIG. 11 shows an illustrative diagrammatic front view of a blade support member in accordance with a further embodiment of the invention that includes a low expansion alloy.

To mitigate this distortion, a low expansion alloy 200 may be applied to an underside surface 202 of the blade supporting beam 100 of FIG. 6 by bonding or other mechanical means as shown in FIG. 11. The resulting bimetallic characteristic is designed to offset the distortion effect of the temperature gradient.

Figure 12:
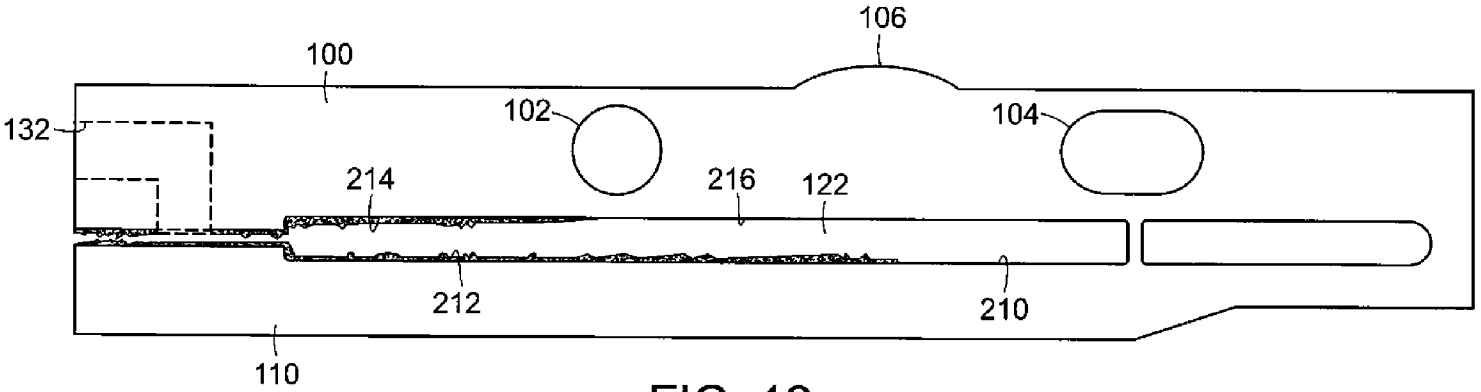
FIG. 12 shows an illustrative diagrammatic front view of a blade support member in accordance with a further embodiment of the invention that includes a thermal barrier.

FIG. 12 shows an embodiment of an alternate approach, in which the topside surface 210 of lever portion 110 is coated with a thermal barrier material 212 such as a temperature resistant polymer, making the lever temperature more uniform and reducing distortion. Similarly, as necessary, coating 214 can be applied to underside surface 216 of the beam 100.

Figure 13A:
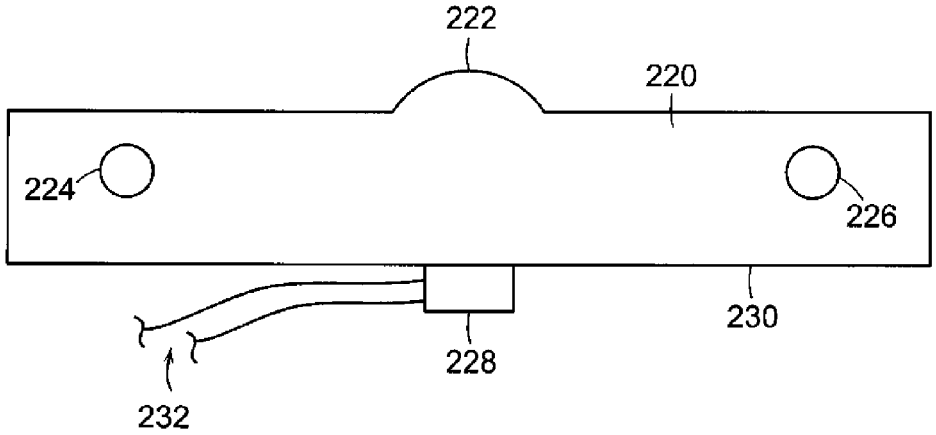
FIGS. 13A and 13B show an illustrative diagrammatic view of a blade support member in accordance with a further embodiment of the invention that includes an accelerometer (FIG. 13A), and show an illustrative diagrammatic view of a blade support member in accordance with a further embodiment of the invention that includes piezoelectric dynamic strain gage (FIG. 13B)

FIG. 13A shows another embodiment of the invention in which a blade support beam 220 that includes a support surface 222 and mounting holes 224, 226, also includes an accelerometer 228 attached to the underside surface 230 of the support beam 220. The blade is loaded against the surface 222, and as such communicates blade vibration spectrum to the support beam 220. Since the accelerometer has been attached at the midspan on the underside surface 230, the output of the accelerometer 228 as provided at 232 should, under most conditions, have measurable vibration spectrum, and the vibration spectrum of the beam should be indicative of the blade vibration spectrum.

Figure 13B:
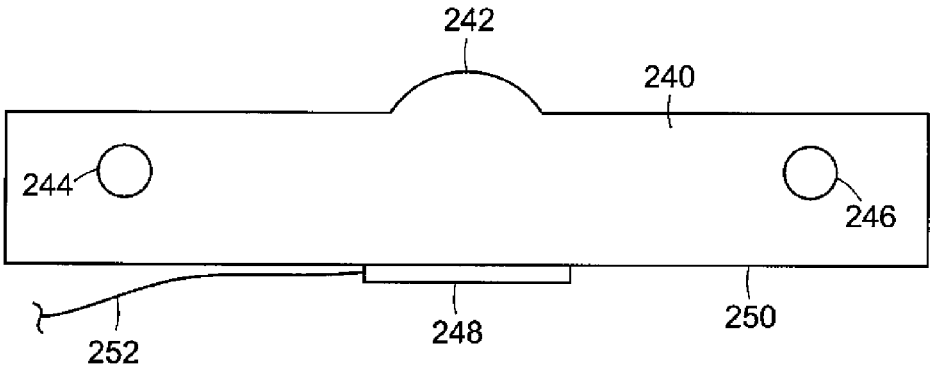

In accordance with another embodiment of the invention a piezoelectric dynamic strain gage may be used. FIG. 13B shows a blade support beam 240 that includes a support surface 242 and mounting holes 244, 246, as well as a piezoelectric dynamic strain gage 248 attached to the underside surface 250 of the support beam 240. Such a strain gage may be a PCB model 740B02. In this application, dynamic strain levels may be measurable to moderately high frequencies (10 kHz), but would thereafter fall off because strain (for constant acceleration) varies inversely with frequency to the 2 power. In this case of dynamic strain measurement, the piezoelectric dynamic strain sensor may have benefits over the conventional strain gage, owing to the high sensitivity of the piezoelectric sensor.

Figure 14A:
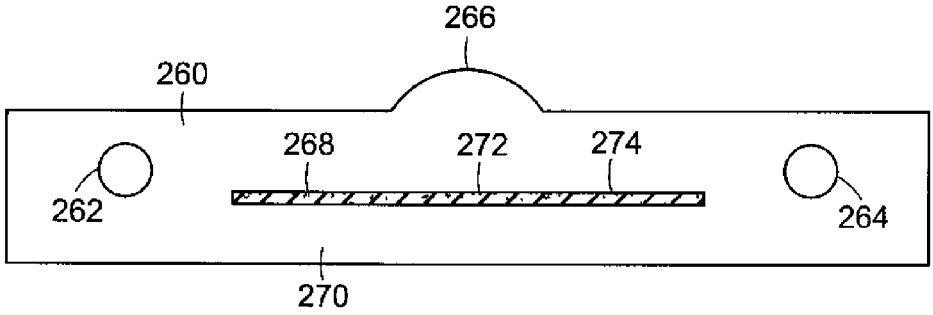
FIGS. 14A and 14B show an illustrative diagrammatic view of a blade support member in accordance with a further embodiment of the invention that includes a viscoelastic material (FIG. 14A), and show an illustrative enlarged view of a portion of the viscoelastic material of FIG. 14A (FIG. 14B)
Figure 14B:
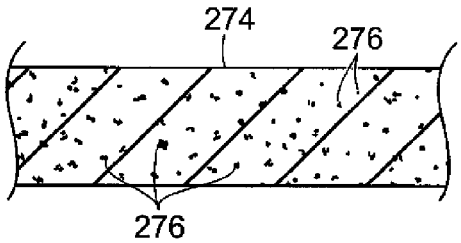

FIG. 14A shows a blade supporting beam 260 in accordance with another embodiment of the invention that has been designed to introduce damping to decrease blade vibration. The beam is mounted at mounting holes 262, 264 to a doctor blade cartridge. The blade loads against surface 266, which deflects the beam at interior surface 268. An integral lower beam portion 270 having an upper surface 272 together with the interior surface 268, provides an enclosed cavity that may be filled with a viscoelastic material 274 to create damping. The viscoelastic material could include nanoparticles, such as nanotubes 276 (as shown diagrammatically in FIG. 14B), to enhance damping.

Figure 15A:
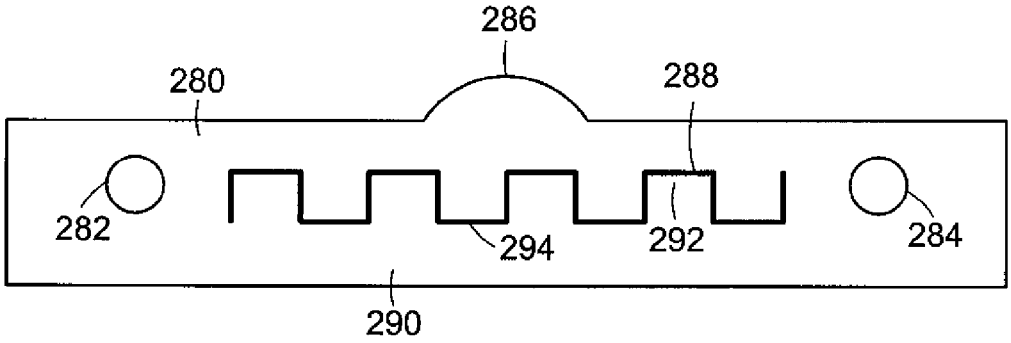
FIGS. 15A and 15B show an illustrative diagrammatic view of a blade support member in accordance with a further embodiment of the invention that includes a damping material in a serpentine geometry (FIG. 15A), and show an illustrative enlarged view of a portion of the damping material of FIG. 15A (FIG. 15B)
Figure 15B:
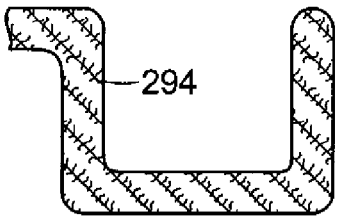

FIG. 15 shows a blade supporting beam in accordance with a further embodiment of the invention that also includes viscoelastic damping. In this case the cavity where the damping material 294 resides is of a serpentine geometry defined by inner serpentine surfaces 288, 292. In particular, the beam is mounted at mounting holes 282, 284 to a doctor blade cartridge. The blade loads against surface 286, which deflects the beam at interior surface 288. An integral lower beam portion 290 having an upper surface 292 together with the interior surface 288, provides an enclosed cavity that may be filled with the viscoelastic material 294 to create damping. In this case the damping material is subjected to shear strain, in addition to tensile and compressive strain. A variety of geometries can lead to enhanced damping, all within the scope of the invention.

Figure 16C:
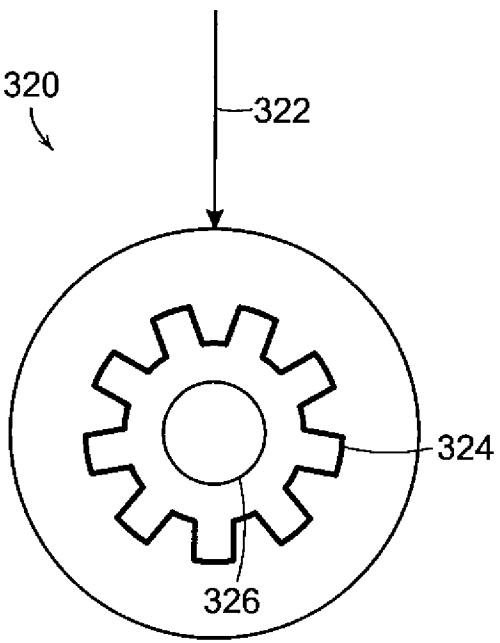
FIGS. 16A-16C show illustrative diagrammatic views of spacer systems employing viscoelastic material for use in blade support members in accordance with further embodiments of the invention.

In accordance with further embodiments of the present invention, a blade supporting member may be provided in the form of a circular spacer that includes viscoelastic material. For example, FIG. 16A shows a blade supporting circular spacer 300 that receives a load from the doctor blade as shown at 302 and includes discontinuous cavities within the spacer 300 that include viscoelastic material 304. The circular spacer is mounted to the doctor blade cartridge via the central mounting hole 306 for supporting the doctor blade along the top row of spacers. The blade acts on the spacer as shown at 302, and introduces strain in viscoelastic material 304.

Figure 16B:
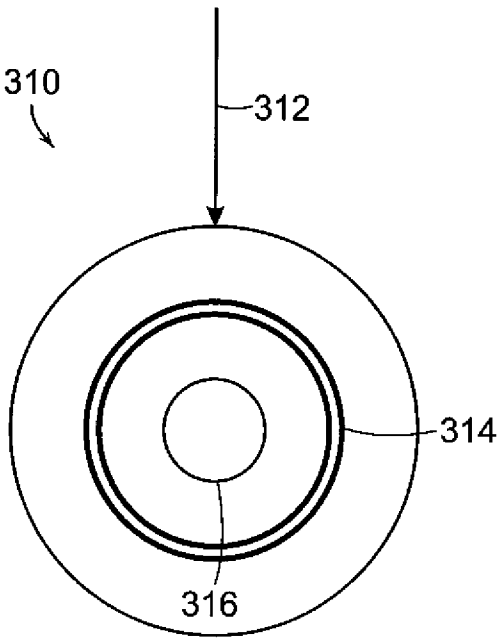
Figure 16A:
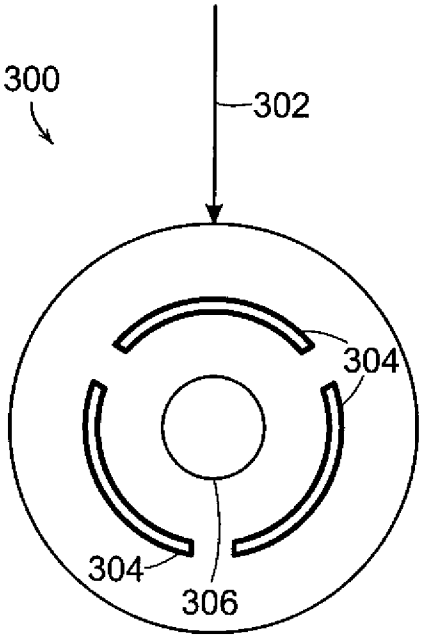

FIG. 16B shows a blade supporting circular spacer 310 that receives a load from the doctor blade as shown at 312 and includes a continuous cavity within the spacer 310 that includes viscoelastic material 314. The circular spacer is mounted to the doctor blade cartridge via the central mounting hole 316 for supporting the doctor blade along the top row of spacers. Again, the blade acts on the spacer as shown at 312, and introduces strain in viscoelastic material 314.

FIG. 16C shows a blade supporting circular spacer 320 that receives a load from the doctor blade as shown at 322 and includes a continuous serpentine cavity within the spacer 320 that includes viscoelastic material 324. The circular spacer is mounted to the doctor blade cartridge via the central mounting hole 326 for supporting the doctor blade along the top row of spacers. Again, the blade acts on the spacer as shown at 322, and introduces strain in viscoelastic material 324.

With respect to the use of viscoelastic damping illustrated in FIGS. 14A-16C, it is understood that a variety of geometric cavities and shapes may be made to achieve high strain, whether shear, tensile or compressive, to achieve damping means, all of which are consistent with the scope of the invention.

Figure 17:
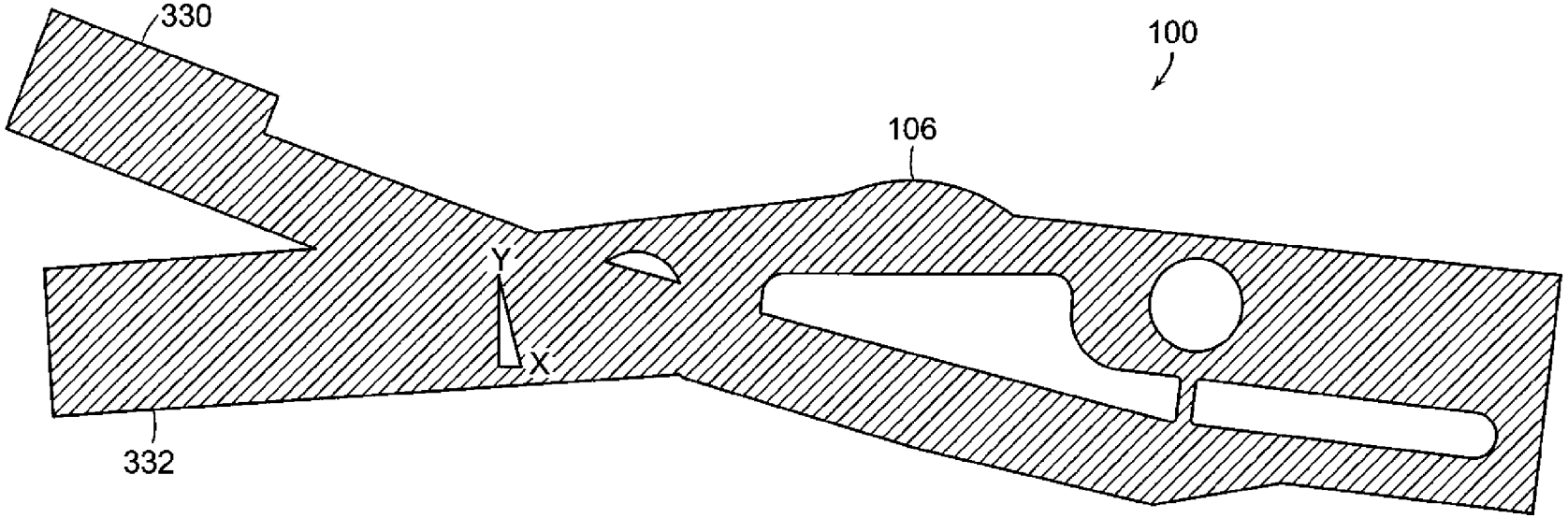
FIG. 17 shows an illustrative diagrammatic view of first vibration mode shape of the blade support member shown in FIG. 6.
Figure 18:
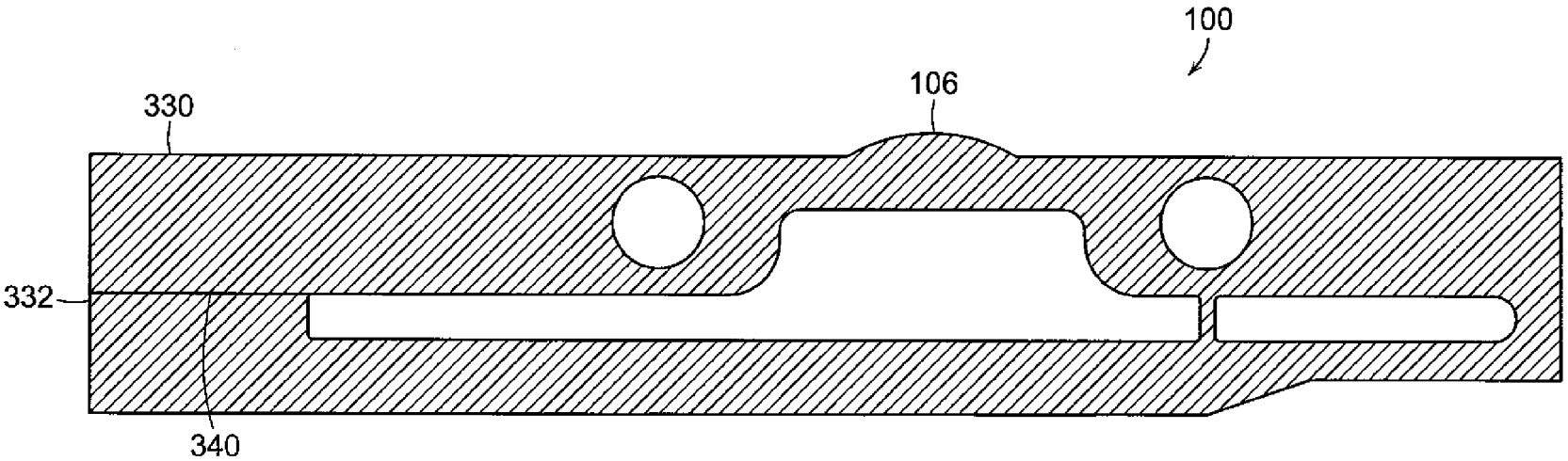
FIG. 18 shows an illustrative diagrammatic view of a blade support member in accordance with a further embodiment of the invention that includes a viscoelastic layer sandwiched between two surfaces on one side of the blade support member.

FIG. 17 shows the first vibration mode shape of the pneumatic beam 100 discussed above at least with reference to FIG. 6. The surface indicated at 330 has large motion with respect to surface indicated at 332. In fact, most modes of this beam have large relative motion associated with these two surfaces. This is advantageous for introducing damping means between these two surfaces. FIG. 18, for example, shows a viscoelastic layer 340 sandwiched between these two surfaces 330 and 332.

Figure 19A:
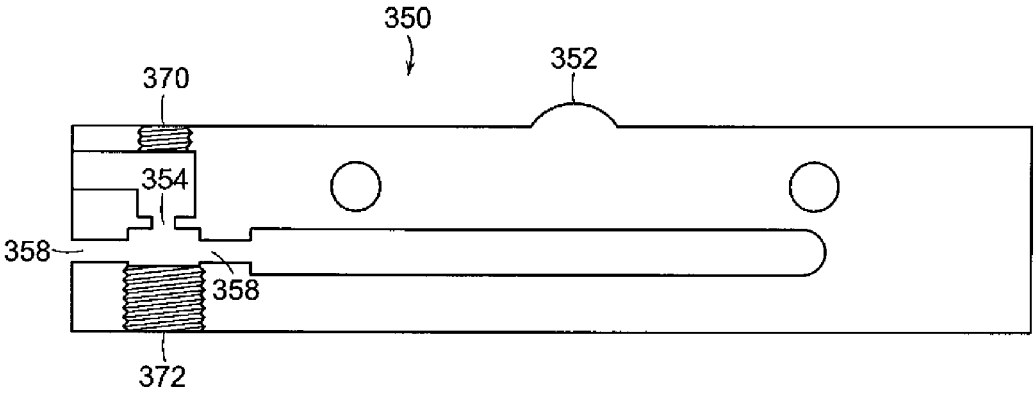
FIGS. 19A and 19B show an illustrative diagrammatic view of a blade support member in accordance with an embodiment of the invention that includes a hydrostatic squeeze film (FIG. 19A), and show an illustrative diagrammatic enlarged view of a portion of the blade support member of FIG. 19A (FIG. 19B).
Figure 19B:
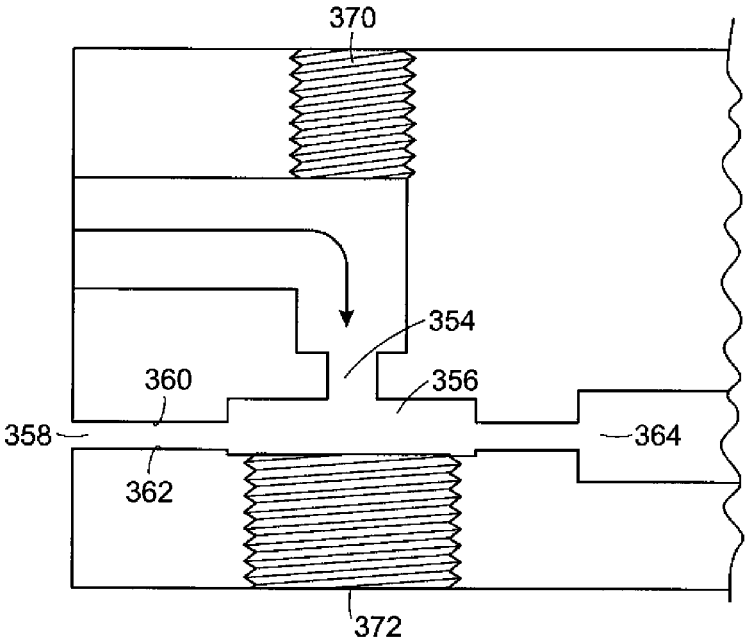

FIG. 19A shows a blade support member that involves the use of a hydrostatic squeeze film for damping in blade supporting beam 350. In this case, fluid flows to restrictor 354, then into cavity pocket 356. The fluid then egresses through side exits 358 and 364. An enlarged view of a portion of the blade support member of FIG. 19A is shown in FIG. 19B. The principle of operation is similar to that of hydrostatic seals and bearings. During blade vibration, the blade vibration spectrum will be communicated to the beam and cause relative motion between surfaces 360 and 362. The oscillation of surfaces 360 and 362 will create a substantial cavity pressure response that will be proportional to surface relative velocity, hence substantial damping will be introduced by hydrostatic squeeze film material. It is understood that other geometry adjustments can be made to allow implementation of squeeze film damping, all of which are consistent with the scope of the invention.

In accordance with further embodiments, doctor blade holder cartridge may be provided that includes any or all of the blade supporting members discussed above to provide strain sensors and displacement sensors as well as vibration detection and damping.

Those skilled in the art will appreciate that numerous modifications and variations may be made to the above disclosed embodiments without departing from the spirit and scope of the present invention.

What is claimed is:

1. A doctor blade cartridge for use in a doctor blade holder, said doctor blade cartridge for receiving a doctor blade, said doctor blade cartridge including at least one blade supporting member, wherein said blade supporting member is sufficiently stiff to support the doctor blade and includes load indication means for providing a signal indicative of at least one of blade supporting member strain and blade supporting member deflection, wherein said doctor blade cartridge includes a plurality of blade supporting members.

2. The doctor blade cartridge as claimed in claim 1, wherein said at least one blade supporting member is a beam.

3. The doctor blade cartridge as claimed in claim 2, wherein said load indication means includes a fiber optic strain sensor for sensing strain.

4. The doctor blade cartridge as claimed in claim 2, wherein said load indication means includes a strain gage strain sensor for sensing strain.

5. The doctor blade cartridge as claimed in claim 2, wherein said load indication means includes lever means for permitting blade load to regulate flow through a variable discharge restrictor.

6. The doctor blade cartridge as claimed in claim 5, wherein said lever means causes upstream pressure to vary approximately linearly with load.

7. The doctor blade cartridge as claimed in claim 5, wherein said lever means includes a bimetallic member to compensate for thermal distortion.

8. The doctor blade cartridge as claimed in claim 5, wherein said lever means includes a thermal coating barrier on a surface thereof to create more uniform temperature and reduce distortion.

9. The doctor blade cartridge as claimed in claim 2, wherein said beam includes a support area for contacting the doctor blade, and wherein said support area is approximately mid-distance between a pair of support mounts by which the beam is attached to the doctor blade cartridge.

10. The doctor blade cartridge as claimed in claim 1, wherein said doctor blade cartridge includes passage means for providing passage of any signal cables and fluid carrying tubes away from the doctor blade cartridge.

11. The doctor blade cartridge as claimed in claim 10, wherein said passage means includes openings within the at least one blade supporting member.

12. A doctor blade cartridge for use in a doctor blade holder, said doctor blade cartridge for receiving a doctor blade, said doctor blade cartridge including at least one blade supporting member, wherein said blade supporting member is sufficiently stiff to support the doctor blade and includes load indication means for providing a signal indicative of at least one of blade supporting member strain and blade supporting member deflection, wherein said at least one blade supporting member is a beam.

13. The doctor blade cartridge as claimed in claim 12, wherein said doctor blade cartridge includes a plurality of blade supporting members.

14. The doctor blade cartridge as claimed in claim 12, wherein said load indication means includes a fiber optic strain sensor for sensing strain.

15. The doctor blade cartridge as claimed in claim 12, wherein said load indication means includes a strain gage strain sensor for sensing strain.

16. The doctor blade cartridge as claimed in claim 12, wherein said doctor blade cartridge includes passage means for providing passage of any signal cables and fluid carrying tubes away from the doctor blade cartridge.

17. The doctor blade cartridge as claimed in claim 16, wherein said passage means includes openings within the at least one blade supporting member.

18. The doctor blade cartridge as claimed in claim 12, wherein said beam includes a support area for contacting the doctor blade, and wherein said support area is approximately mid-distance between a pair of support mounts by which the beam is attached to the doctor blade cartridge.

19. The doctor blade cartridge as claimed in claim 12, wherein said load indication means includes lever means for permitting blade load to regulate flow through a variable discharge restrictor.

20. The doctor blade cartridge as claimed in claim 19, wherein said lever means causes upstream pressure to vary approximately linearly with load.

21. The doctor blade cartridge as claimed in claim 19, wherein said lever means includes a bimetallic member to compensate for thermal distortion.

22. The doctor blade cartridge as claimed in claim 19, wherein said lever means includes a thermal coating barrier on a surface thereof to create more uniform temperature and reduce distortion.

23. A doctor blade cartridge for use in a doctor blade holder, said doctor blade cartridge for receiving a doctor blade, said doctor blade cartridge including at least one blade supporting member, wherein said blade supporting member is sufficiently stiff to support the doctor blade and includes load indication means for providing a signal indicative of at least one of blade supporting member strain and blade supporting member deflection, wherein said doctor blade cartridge includes passage means for providing passage of any signal cables and fluid carrying tubes away from the doctor blade cartridge.

24. The doctor blade cartridge as claimed in claim 23, wherein said doctor blade cartridge indicates a plurality of blade supporting members.

25. The doctor blade cartridge as claimed in claim 23, wherein said beam includes a support area for contacting the doctor blade, and wherein said support area is approximately mid-distance between a pair of support mounts by which the beam is attached to the doctor blade cartridge.

26. The doctor blade cartridge as claimed in claim 23, wherein said passage means includes openings within the at least one blade supporting member.

27. The doctor blade cartridge as claimed in claim 23, wherein said at least one blade supporting member is a beam.

28. The doctor blade cartridge as claimed in claim 27, wherein said load indication means includes a fiber optic strain sensor for sensing strain.

29. The doctor blade cartridge as claimed in claim 27, wherein said load indication means includes a strain gage strain sensor for sensing strain.

30. The doctor blade cartridge as claimed in claim 27, wherein said load indication means includes lever means for permitting blade load to regulate flow through a variable discharge restrictor.

31. The doctor blade cartridge as claimed in claim 30, wherein said lever means causes upstream pressure to vary approximately linearly with load.

32. The doctor blade cartridge as claimed in claim 30, wherein said lever means includes a bimetallic member to compensate for thermal distortion.

33. The doctor blade cartridge as claimed in claim 30, wherein said lever means includes a thermal coating barrier on a surface thereof to create more uniform temperature and reduce distortion.

* * * * *